US007375310B2

(12) United States Patent
Oh et al.

(10) Patent No.: US 7,375,310 B2
(45) Date of Patent: May 20, 2008

(54) AIR FLOW SYSTEM FOR CIRCULATING AIR IN A MICROWAVE OVEN

(75) Inventors: Gyu Ho Oh, Kyungsang-do (KR); Young Chul Kim, Kyungsangnam-do (KR)

(73) Assignee: LG Electronics, Inc., Seoul (KR)

( * ) Notice: Subject to any disclaimer, the term of this patent is extended or adjusted under 35 U.S.C. 154(b) by 89 days.

(21) Appl. No.: 10/565,212

(22) PCT Filed: Jul. 13, 2004

(86) PCT No.: PCT/KR2004/001727

§ 371 (c)(1),
(2), (4) Date: Jan. 20, 2006

(87) PCT Pub. No.: WO2005/008138

PCT Pub. Date: Jan. 27, 2005

(65) Prior Publication Data

US 2006/0157481 A1 Jul. 20, 2006

(30) Foreign Application Priority Data

Jul. 21, 2003 (KR) ..... 10-2003-0049775
Jul. 25, 2003 (KR) ..... 10-2003-0051478

(51) Int. Cl.
*H05B 6/80* (2006.01)

(52) U.S. Cl. ..... 219/757; 219/681; 126/21 A; 126/299 R

(58) Field of Classification Search ..... 219/756–757, 219/681, 400; 126/21 A, 299 R, 299 D
See application file for complete search history.

(56) References Cited

U.S. PATENT DOCUMENTS

| | | | | |
|---|---|---|---|---|
| 4,618,756 | A | 10/1986 | Schwaderer et al. | 219/10.55 |
| 5,918,589 | A | 7/1999 | Valle et al. | 126/193 |
| 6,344,637 | B2 | 2/2002 | Lee et al. | 219/757 |
| 6,621,058 | B1 * | 9/2003 | Kim | 219/757 |

OTHER PUBLICATIONS

International Search Report.

* cited by examiner

*Primary Examiner*—Philip H. Leung
(74) *Attorney, Agent, or Firm*—Ked & Associates, LLP

(57) ABSTRACT

An air flow system in oven is provided. The structure includes: a cavity for housing food; a ventilation fan provided at an electronic equipment chamber outside of the cavity; a first intake port provided at a front and upper surface of the microwave oven; a lower barrier for partitioning a lower space of the cavity; an outlet duct provided at one side of the lower barrier, for allowing a flow of hot air using the ventilation fan; an outlet space provided at the other side of the lower barrier, for exhausting an internal air of the cavity; a plurality of front outlet ports provided at a front and lower surface of the microwave oven, for exhausting hot air of the outlet duct and the outlet space; and a communication port provided at one side of the lower barrier, for communicating the outlet duct with the outlet space.

30 Claims, 6 Drawing Sheets

AIR FLOW SYSTEM FOR CIRCULATING AIR IN A MICROWAVE OVEN

TECHNICAL FIELD

The present invention relates to an air passage structure for a microwave oven, and more particularly, to an air passage structure for a microwave oven in which dew is prevented from being generated at a front surface of a microwave oven by wet air exhausted from the microwave oven.

BACKGROUND ART

Microwave oven is a device for generating microwave from a magnetron by supplying a current to irradiate the microwave to a target object such as the food, thereby heating the food. The microwave oven is classified into a general microwave oven and a combined hood and microwave oven. The general microwave oven is used on kitchen furniture. The combined hood and microwave oven is provided on a wall surface over a gas oven range. Additionally, the microwave oven can have a general door where opening and closing are laterally performed or a drop down door where opening and closing are performed up and down. The microwave oven with the drop down door is described as an example of the present invention.

Alternatively, the microwave oven has a tendency of large-sizing a food housing capacity to more quickly cook a large amount of food. However, as the microwave oven is large-sized for the above-purpose, the microwave oven generates much moisture during the cooking of the food. Accordingly, a method for removing the generated moisture is much required. Further, as the microwave oven has a large capacity, an electronic equipment chamber including the magnetron generates much heat. Accordingly, a method for removing the generated heat is also required.

In detail, hot and humid air exhausted from one side of the microwave oven has a difference from an external air in temperature by a predetermined level. Therefore, vapor contained in the exhausted air is condensed. In particular, there is a drawback in that if a glass forming an exterior of the microwave oven is exposed to the hot and humid air, dew is generated at a surface of the glass. Due to the above drawback, a user feels unpleasantness, and corrosion occurs in case where particles of the food are contained in the condensed air.

Further, electronic equipments of a large-sized microwave oven generate a large amount of heat. If the heat is not dissipated enough, it causes abnormal operations of the electronic equipments. Therefore, a new air passage structure for a microwave oven is required to introduce air enough to cool the electronic equipments and quickly exhaust hot air that was used for cooling the electronic equipments.

DISCLOSURE OF THE INVENTION

Accordingly, the present invention is directed to an air passage structure for a microwave oven that substantially obviates one or more of the problems due to limitations and disadvantages of the related art.

An object of the present invention is to provide an air passage structure for a microwave oven in which an intake port for external air and an exhaust port for hot air are improved to more quickly cool the microwave oven.

Another object of the present invention is to provide an air passage structure for a microwave oven in which a plurality of intake ports and a plurality of exhaust ports are provided to more smoothly introduce and exhaust air into and from the microwave oven.

A further another object of the present invention is to provide an air passage structure for a microwave oven in which while the microwave oven cooks, wet air is prevented from being condensed at one side part of the microwave oven to increase a pleasure in use and improve a sanitary problem.

To achieve these and other advantages and in accordance with the purpose of the present invention, as embodied and broadly described, there is provided an air passage structure for a microwave oven, the structure including: a cavity for housing food; a ventilation fan provided at an electronic equipment chamber outside of the cavity; a first intake port provided at a front and upper surface of the microwave oven; a lower barrier for partitioning a lower space of the cavity; an outlet duct provided at one side of the lower barrier, for allowing a flow of hot air using the ventilation fan; an outlet space provided at the other side of the lower barrier, for exhausting an internal air of the cavity; a plurality of front outlet ports provided at a front and lower surface of the microwave oven, for exhausting hot air of the outlet duct and the outlet space; and a communication port provided at one side of the lower barrier, for communicating the outlet duct with the outlet space.

According to another aspect of the present invention, there is provided an air passage structure for a microwave oven, the structure including: a cavity for housing food; an electronic equipment chamber in which a plurality of electronic equipments is provided to control the cavity; an outer case encompassing the cavity and the electronic equipment chamber to form an exterior; a door for selectively opening and closing a front of the cavity; a first intake port provided at an upper side of the door, for allowing the introduction of air; a front outlet port provided at a front and lower side of the microwave oven such that the introduced air is exhausted to a front of the microwave oven; a ventilation fan assembly provided at the electronic equipment chamber, for inhaling air through the intake port and exhausting the air through the outlet port.

According to a further another aspect of the present invention, there is provided an air passage structure for a microwave oven, the structure including: a cavity for housing food; an electronic equipment chamber in which a plurality of electronic equipments is provided to control the cavity; an outer case encompassing the cavity and the electronic equipment chamber to form an exterior; a door for selectively opening and closing a front of the cavity; a control panel for displaying a state of the cavity; an intake port provided at a rear side of the electronic equipment chamber, for allowing the introduction of air into the electronic equipment chamber; a lower outlet port provided at a lower side of the microwave oven; a ventilation fan assembly provided at the electronic equipment chamber, for inhaling air through the intake port and exhausting the air through the outlet port.

According to a still another aspect of the present invention, there is provided an air passage structure for a microwave oven, the structure including: a cavity for housing food; a ventilation fan provided at an electronic equipment chamber outside of the cavity; an intake port provided at a front and upper surface of the microwave oven and/or at a rear surface of the microwave oven; a lower barrier provided at a lower side of the cavity, for partitioning a lower space of the cavity; an outlet duct provided at one side of the lower barrier, for allowing a flow of hot air using the ventilation fan; an outlet space provided at the other side of the lower barrier, for exhausting an internal air of the cavity; and an outlet port provided at a front surface of the microwave oven and/or at a lower side of the microwave oven, for exhausting the hot air.

According to a still further another aspect of the present invention, there is provided an air passage structure for a microwave oven, the structure including: a cavity for housing food within the microwave oven; a door for opening and closing the cavity; an intake port provided at an upper side of the door and/or at a rear side of the microwave oven; a ventilation fan provided within the electronic equipment chamber, for inhaling air through the intake port; and an outlet port provided at a front and lower surface of the microwave oven and/or at a lower surface of the microwave oven, for exhausting the air passing though the ventilation fan.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Hereinafter, preferred embodiments of the present invention will be described in detail with reference to accompanying drawings.

Figure 1:
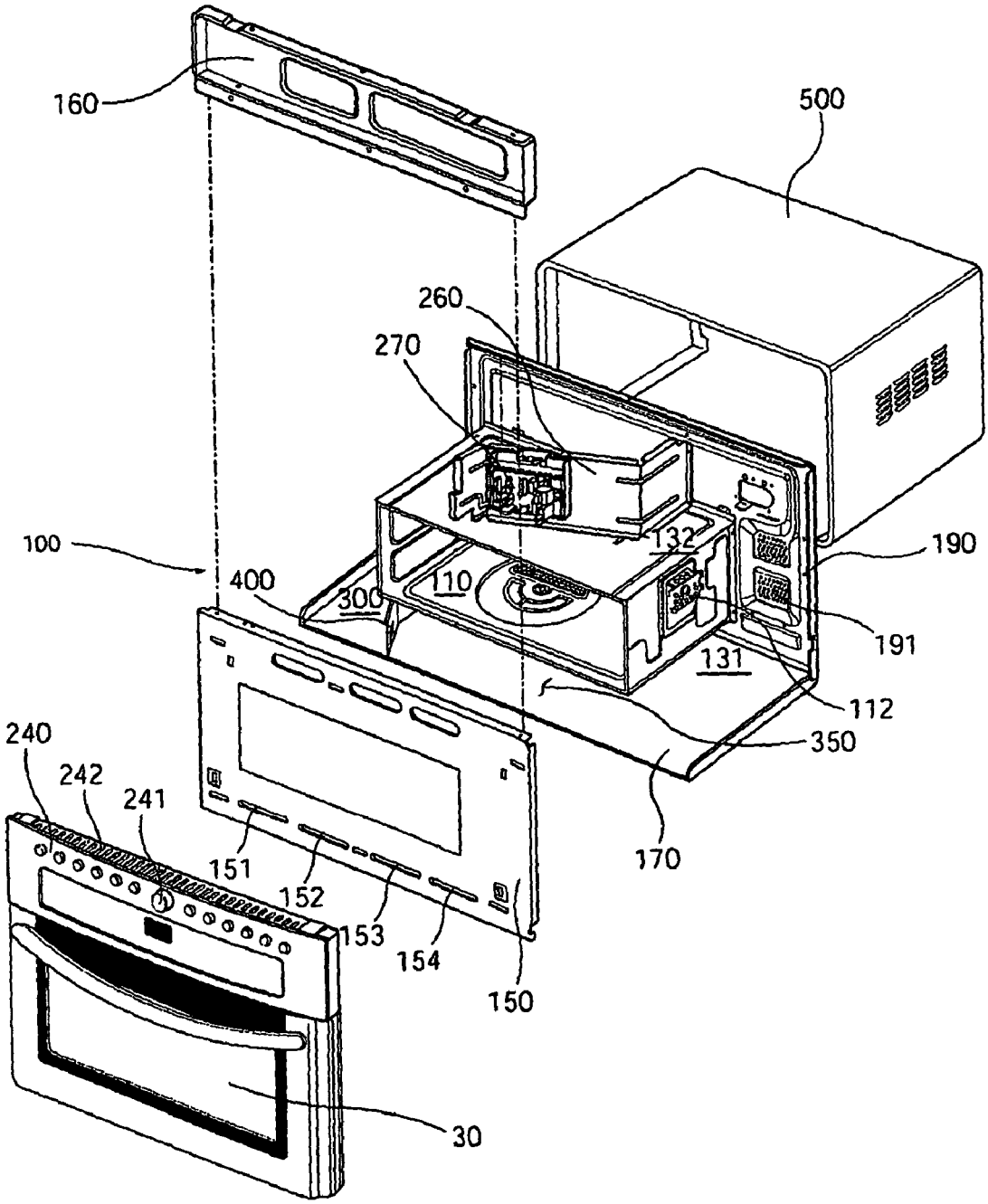
FIG. 1 is a perspective view illustrating an air passage structure for a microwave oven according to the present invention.

FIG. 1 is a perspective view illustrating an air passage structure for a microwave oven according to the present invention.

Referring to FIG. 1, the inventive microwave oven includes a cavity assembly 100 in which food is cooked; a door 30 openably provided at a front of the microwave oven; an outer case 500 forming an exterior of the microwave oven; and a front bracket 160 provided at an upper side of the door 30. The cavity assembly 100 includes a main electronic equipment chamber 131 and an auxiliary electronic equipment chamber 132 for housing various electronic equipments, which are respectively provided at a right side and a left side of the cavity 110 to control cooking of food; a front plate 150 provided at a front of the cavity 110; a base plate 170 provided at a bottom of the cavity 110; and a back plate 190 provided at a rear of the cavity 110.

The above structural elements are in detail described hereinafter.

The main electronic equipment chamber 131 is provided at the right side of the cavity 110. The main electronic equipment chamber 131 includes a magnetron (not shown) for generating microwave; a wave guide (not shown) for guiding an electronic wave; and a transformer (not shown) for controlling a voltage of current supplied to the magnetron. Additionally, a ventilation fan (Referring to 136 of FIG. 2) is provided approximately at the backside of the main electronic equipment chamber 131 to inhale and exhaust air from and to the external of the microwave oven.

Further, the auxiliary electronic equipment chamber 132 houses a plurality of electronic parts for driving the microwave oven. A plate-shaped upper barrier 260 is provided at the auxiliary electronic equipment chamber 132 to divide the auxiliary electronic equipment chamber 132 in a diagonal direction. A substrate assembly 270 is further provided on a front surface of the upper barrier 260 to control a state of the cavity 110.

Further, a second intake port 191 is provided at the back plate 190 to introduce air to the ventilation fan 136. The second intake port 191 allows external air to be introduced into the main electronic equipment chamber 131 through a front and rear of the back plate 190 by the ventilation fan 136. Further, an outlet duct 350 is provided between the base plate 170 that is provided at a lower side of the cavity 110, and a lower surface of the cavity 110. The outlet duct 350 is formed along the lower surface of the cavity 110. The outlet duct 350 is communicated with the main electronic equipment chamber 131 to flow the air that is forcibly ventilated by the ventilation fan 136, toward the main electronic equipment chamber 131 and the outlet duct 350.

Further, a right wall surface of the cavity 110 is punched to form a plurality of inlet ports 112 at the right wall surface of the cavity 110 such that the cavity 110 inhales a portion of the air from the main electronic equipment chamber 131. A left wall surface of the cavity 110 is punched to form a plurality of outlet ports (Referring to 111 of FIG. 5) for exhausting hot air from the cavity 110. Accordingly, a portion of the air ventilated by the ventilation fan 136 is inhaled into the cavity 110 through the inlet port 112, and is exhausted to the external of the cavity 110 through the outlet port 111. Since the air exhausted through the outlet port 111 has heat and moisture generated during the cooking of the food, the air can be easily expected to be hot and humid.

Furthermore, a left side of the outlet duct 350 is almost closed by a lower barrier 400 provided at a left side of the cavity 110. If the lower barrier 400 is provided as described above, a predetermined outlet space 300 is provided by the outer case 500, the lower barrier 400, a left surface of the cavity 110, the upper barrier 260, the back plate 190 and the front plate 150. The hot air containing vapor of within the cavity 110 is exhausted through the outlet port 111 and is stored in the outlet space 300 for a predetermined time. The air stored in the outlet space 300 is a humid air containing a large amount of moisture, which is evaporated during the cooking.

Additionally, front outlet ports 151, 152, 153 and 154 having predetermined sizes are provided side by side at a lower side of the front plate 150. The front outlet port is a passage for exhausting, to a front and lower side of the microwave oven, the air guided by the outlet duct 350 and the air guided by the lower barrier 400 in the outlet space 300. In detail, the first front outlet port 151 provided at the most left side is a region at which the stored hot and humid air is exhausted from the outlet space 300. The second, third and fourth front outlet ports 152, 153 and 154 are regions at which the hot air is exhausted from the outlet duct 350. Since the hot air, which cooled the electronic equipment chambers 131 and 132, flows through the outlet duct 350, the hot air of the outlet duct 350 can be easily expected to be at a dry state.

Furthermore, a control panel 240 is provided at an upper side of the door 30, and a plurality of buttons 241 is provided on an upper and front surface of the control panel 240 for allowing a user's operation of the microwave oven. Additionally, a plurality of first intake ports 242 is provided on an upper surface of the control panel 240. The first intake port 242 is extended from a front to a rear of the upper end of the control panel 240 by a width of the upper surface of the control panel 240 to have an elongate shape. The upper surface of the control panel 240 is punched to form the first intake port 242. Accordingly, the external air is introduced into the microwave oven through the first intake port 242, and more particularly, into the auxiliary electronic equipment chamber 132 provided at the upper side of the cavity 110.

Figure 2:
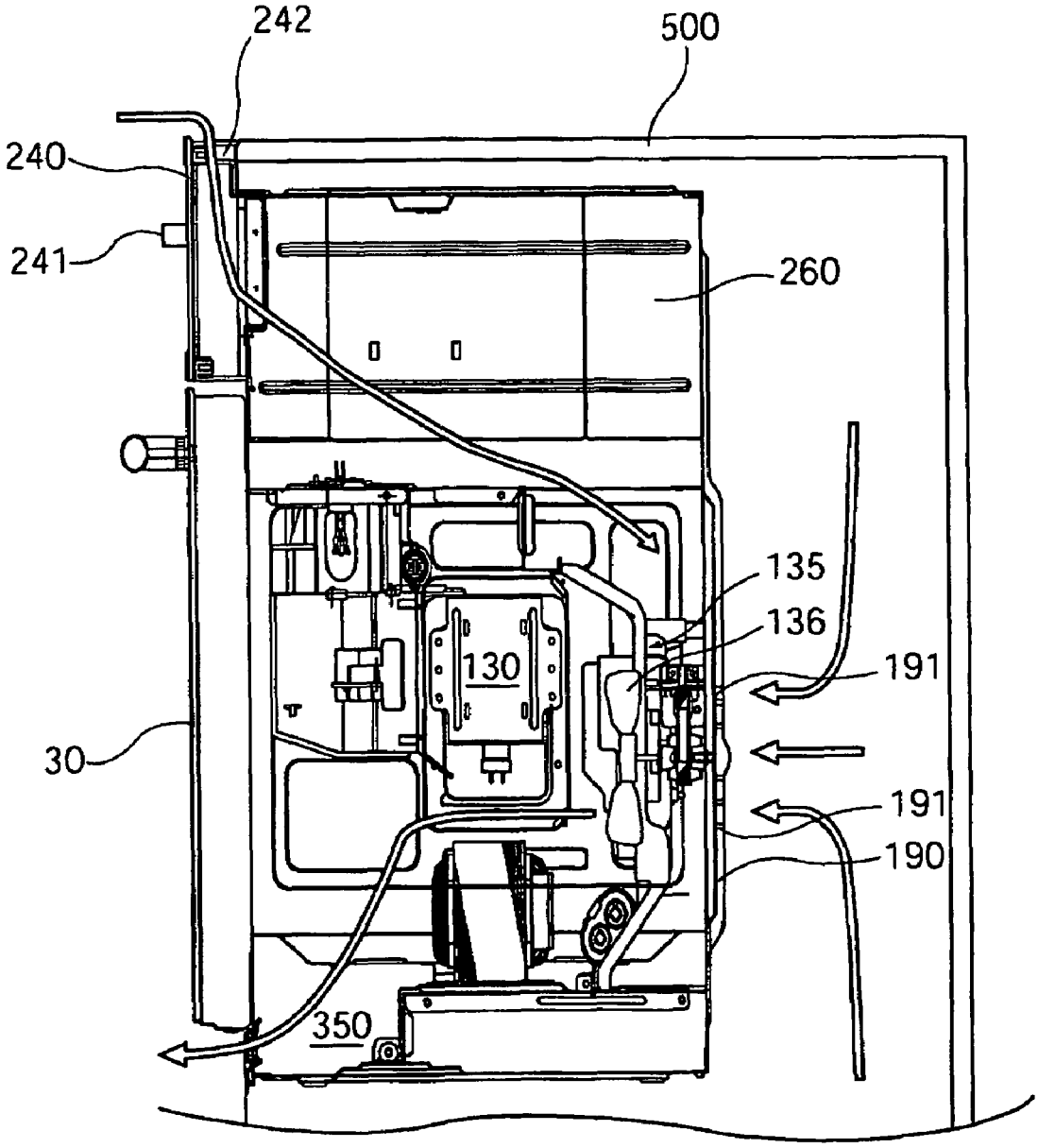
FIG. 2 is a right side view illustrating an air passage structure for a microwave oven from which an outer case is detached according to the present invention.

FIG. 2 is a right side view illustrating the air passage structure for the microwave oven from which the outer case is detached according to the present invention. Airflow in the microwave oven is in detail described with reference to FIG. 2.

First, a procedure of inhaling the air is described. If the ventilation fan 136 of the ventilation fan assembly 135 is rotated, the air is moved from the front of the ventilation fan 136 to a front of the main electronic equipment chamber 131. At this time, a predetermined pressure difference is generated between the external of the microwave oven and the main electronic equipment chamber 131. The pressure difference causes the main electronic equipment chamber 131 to have an internal pressure maintained to be at a lower state than an atmosphere pressure. Accordingly, the external air with the atmosphere pressure is inhaled inside of the microwave oven.

In detail, the external air is inhaled into the main electronic equipment chamber 131 through two intake passages. First, an upper air of the microwave oven is inhaled into the main electronic equipment chamber 131 via the auxiliary electronic equipment chamber 132, which is disposed at an upper side of the cavity, through the first intake port 242 provided at the upper surface of the control panel 240. Accordingly, if the predetermined pressure difference is generated by a rotation of the ventilation fan 136, the air is inhaled from outside and rear of the microwave oven into the main electronic equipment chamber 131 through the second intake port 191 of the back plate 190. As a result, the air is inhaled into the main electronic equipment chamber 131 through the first intake port 242 and, at the same time, the second intake port 191. The above air passage will be apparently understood by the designations of arrows.

Additionally, a procedure of exhausting the air is performed by the ventilation assembly in the same method. The rotation of the ventilation fan 136 causes the internal air of the main electronic equipment chamber 131 to move to the front of the main electronic equipment chamber 131. At this time, a lower part of the main electronic equipment chamber 131 is communicated with the outlet duct 350. Therefore, the hot air of the main electronic equipment chamber 131 is exhausted from the outlet duct 350 to the front of the microwave oven through the front outlet ports 152, 153 and 154 of the front plate 150. However, the first front outlet port 151 exhausts the hot and humid air from the outlet space 300, and does not directly communicate with the outlet duct 350.

Alternatively, a portion of the air moving to the front of the ventilation fan 136 cools the magnetron provided in the main electronic equipment chamber 131, and then is guided by an intake guide (not shown). In a state where the intake guide is extended to the inlet port 112 of the cavity, the guided air is introduced into the cavity 110. The air passing through the cavity 110 is introduced into the outlet space 300, which is provided at the left side of the microwave oven, through the outlet port 111 of the cavity. At this time, since the lower barrier 400 and the upper barrier 260 are provided between the outlet space 300 and the outlet duct 350, the lower barrier 400 and the upper barrier 260 prevent the hot and humid air from being drifted back from the outlet space 300 to the main electronic equipment chamber 131.

Further, the lower barrier 400 separates the front outlet port 151 from the front outlet ports 152, 153 and 154 of the front plate 150. Accordingly, the hot air of the outlet duct 350 is mainly exhausted to the front outlet ports 152, 153 and 154, and the hot and humid air of the outlet space 300 is mainly exhausted to the front outlet port 151.

As suggested, the inventive air passage structure of the microwave oven allows the air to be smoothly introduced through the first intake port provided at the upper and front side of the microwave oven and the second intake port provided at the rear side of the microwave oven. Additionally, since the hot air is exhausted through a wide area of the outlet duct provided at the lower side of the microwave oven, a cooling efficiency of the microwave oven can be more enhanced. The air passage of the microwave oven can be apparently understood by the designations of the arrows.

Figure 3:
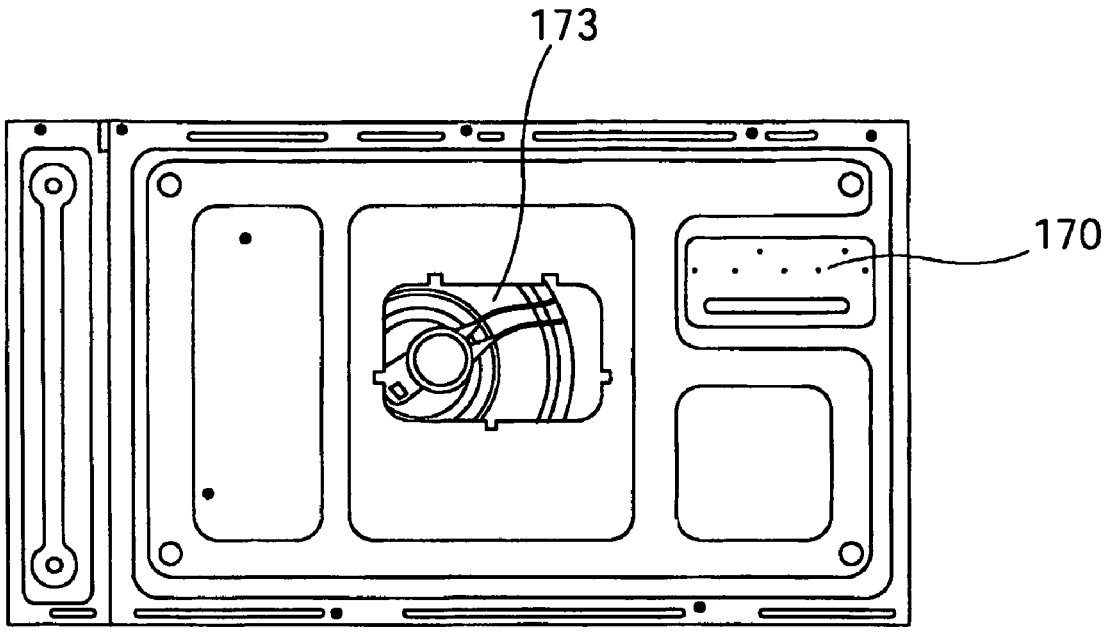
FIG. 3 is a bottom view illustrating a base plate of an air passage structure for a microwave oven according another embodiment of the present invention.

FIG. 3 is a bottom view illustrating a base plate of an air passage structure for a microwave oven according another embodiment of the present invention. FIG. 3 illustrates a state where the microwave oven is overturned to expose a bottom surface of the base plate.

Referring to FIG. 3, a predetermined size of a lower outlet port 173 is provided at an inner center of the base plate 170. The base plate 170 is punched to form the lower outlet port 173 through which the air, which is guided to the outlet duct 350, is exhausted downward of the microwave oven. Accordingly, the heated air can be exhausted from the electronic equipment chambers 131 and 132 even through the lower outlet port 173. Therefore, the microwave oven has totally two intake passages and two exhaust passages.

Figure 4:
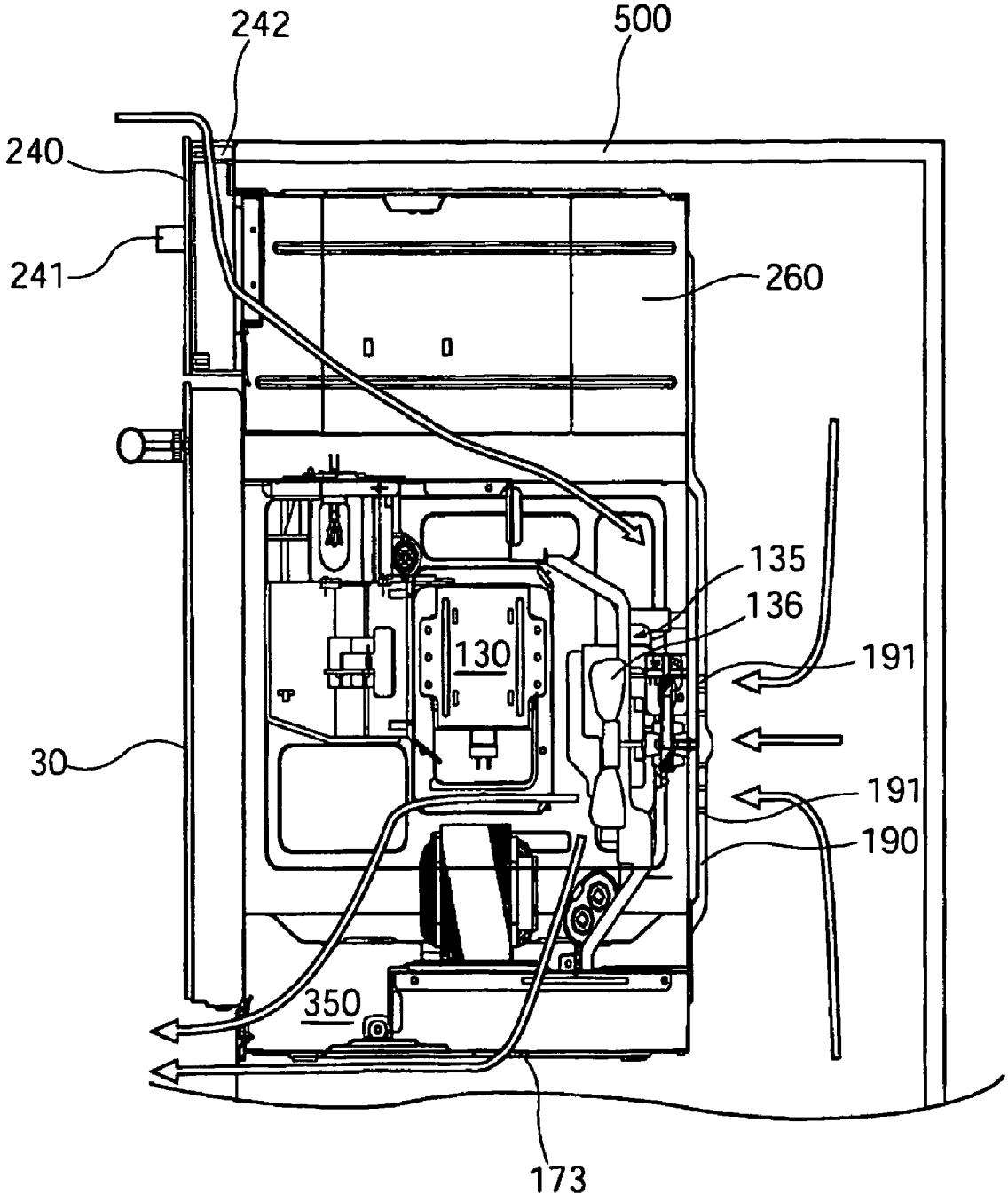
FIG. 4 is a left side view illustrating an air passage structure for a microwave oven according to another embodiment of the present invention.

FIG. 4 is a left side view illustrating the air passage structure for the microwave oven according to another embodiment of the present invention.

Referring to FIG. 4, most of descriptions can quote the description of the earlier embodiment, and this embodiment is different from the earlier embodiment in that the lower outlet port 173 is provided. Therefore, the air is inhaled through the passage having the first intake port 242 and the second intake port 191, and the air is exhausted through the passage having the front outlet ports 151, 152, 153 and 154 and the lower outlet port 173. If a plurality of intake passages and a plurality of exhaust passages are formed as described above, the airflow of the microwave oven is more smoothly made. Therefore, even though the cavity and the electronic equipment are increased in size, the electronic equipment chamber can be quickly cooled without difficulty.

Alternatively, it can be understood from this embodiment that the first front outlet port 151 exhausts the hot and humid air passing through the cavity 110. In case where the hot and humid air is exhausted through the first front outlet port 151 as it is, a glass structure of the door 30 can be dewy. In other words, if the hot and humid air meets a cold door 30, the door 30 is dewy in a moment. A device for improving the above drawback is suggested.

Figure 5:
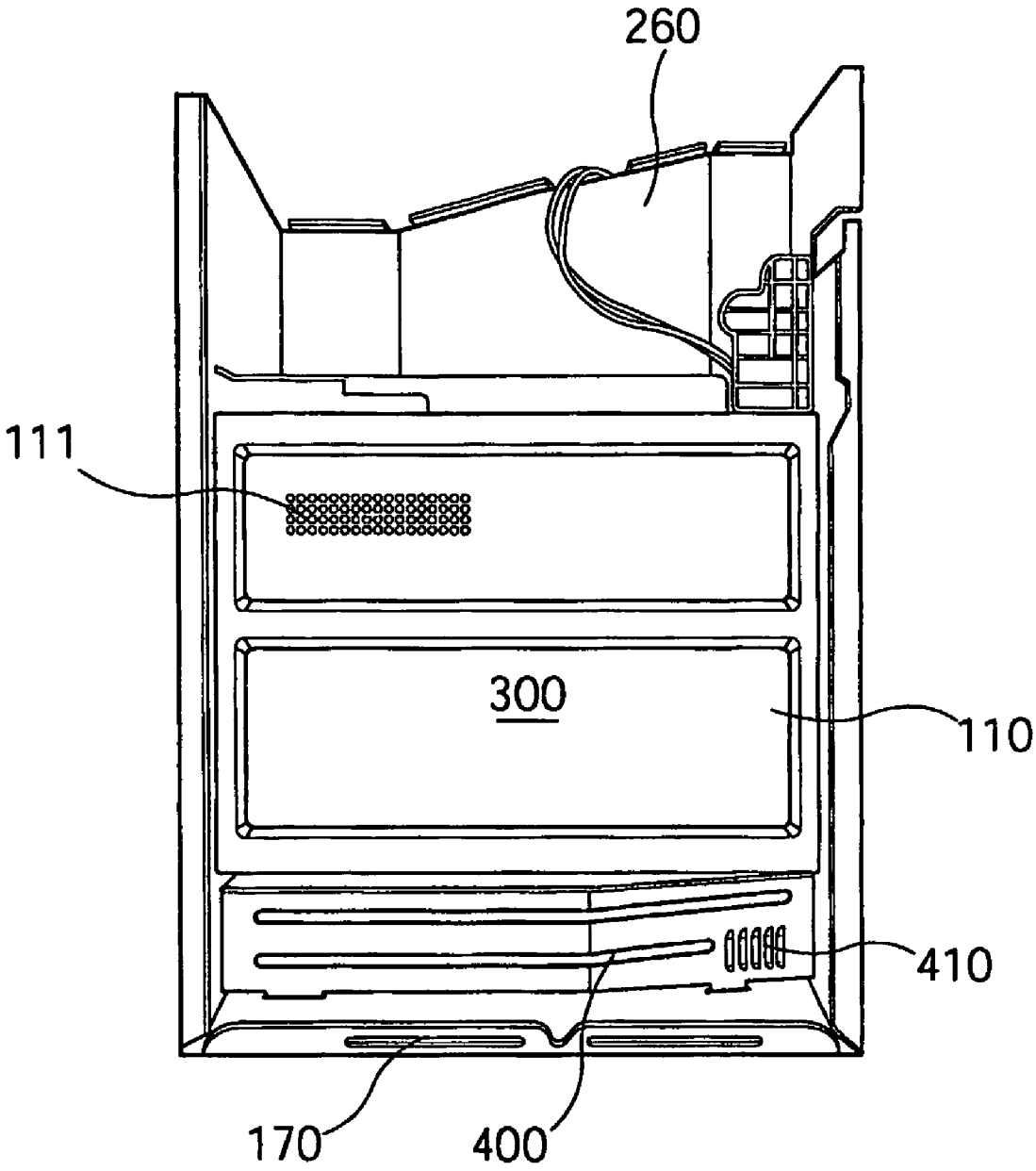
FIG. 5 is a left side view illustrating an air passage structure for a microwave oven from which an outer case is detached according to the present invention.
Figure 6:
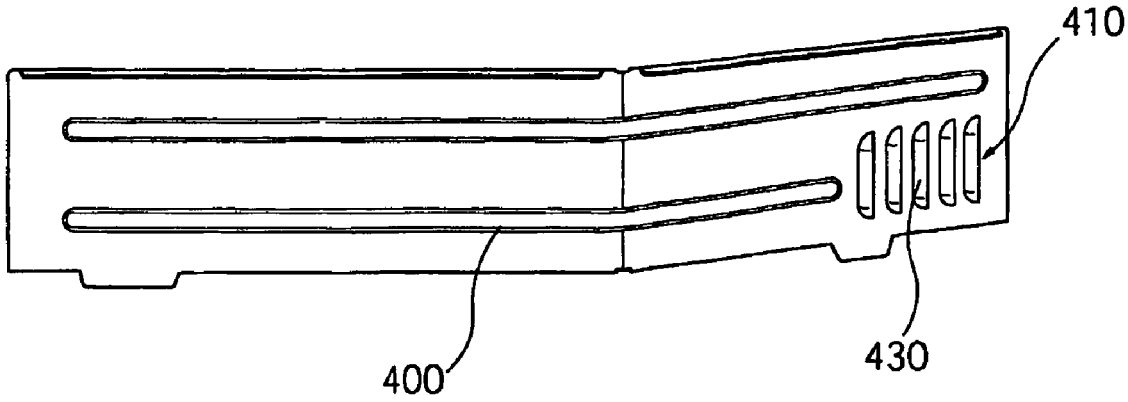
FIG. 6 is a side view illustrating a bottom barrier according to the present invention.

FIG. 5 is a left side view illustrating the air passage structure for the microwave oven from which the outer case is detached according to the present invention, and FIG. 6 is a side view illustrating a bottom barrier according to the present invention.

Referring to FIGS. 5 and 6, the lower barrier 400 is bent to have an "L"-shape at a left and lower corner of the cavity 110. Of course, the outlet space 300 and the outlet duct 350 are separated from each other using the lower barrier 400. Further, a communication port 410 is provided, through punching, at a front of the lower barrier 400. The communication port 410 is covered by an air guide part (Referring to 430 of FIG. 6). If the communication port 410 and the air guide part 430 are provided, a portion of the air flowing the outlet duct 350 is introduced into the outlet space 300.

Further, the air guide part 430 is slantingly formed to open the communication port 410 in a front direction of the microwave oven, that is, in a direction of airflow of the outlet space 300. Due to the air guide part 430, the air passing through the communication port 410 can be exhausted to the front of the microwave oven. By the air guide part 430, the air of the outlet space 300 is not drifted-back toward the outlet duct 350. Further, the air of the outlet duct 300 is not more reliably introduced into the outlet duct 350. Of course, it can be easily expected that the internal air of the outlet space 300 has a relative low pressure since it passing through the cavity and a plurality of passages, and that the internal air of the outlet duct 350 is not drifted-back since it passing through only the electronic equipment chamber.

The air guide part 430 can be conveniently manufactured through a procedure of cutting and bending a portion of the lower barrier 400.

Non-described part of this embodiment can quote the earlier embodiment.

Exhausting the internal air of the microwave oven is described as below. A portion of the internal hot air of the outlet duct 350 is guided by the air guide part 430 through the communication port 410, and is exhausted toward the outlet duct 300. Additionally, the internal hot air of the outlet duct 350 is mixed with the internal hot and humid air of the outlet space 300 to reduce a relative humidity in the outlet space 300. As such, the air having a low relative humidity is exhausted from the outlet space 300 to the external through the first front outlet port 151 of the front plate 150. Since the exhausted air has the low relative humidity, the exhausted air cannot generate the dew at the door 30 even when being in contact with the door 30.

Further, since the communication port 410 is formed at a front of the lower barrier 400, it can also directly heat the glass of the door to effectively prevent the dew from being generated at the glass of the door.

The inventive air passage structure for the microwave oven has two intake passages, and one or two exhaust passages. Even in case where the intake/exhaust passages are provided at positions different from the described positions, the same effect can be obtained as in the above-described embodiment.

Further, the inventive microwave oven can also operate with a combination of more than any one selected intake passage and/or exhaust passage, not with the plurality of intake passages and/or exhaust passages.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

The inventive air passage structure can be applied to a large-sized microwave oven, thereby more quickly and safely cooling the microwave oven at which high heat is generated. Accordingly, the large-sized microwave oven can be more convenient in use.

Further, the inventive air passage structure can reduce the humidity of the air exhausted from the microwave oven to prevent the generation of the dew at a lower part of the microwave oven and prevent the door from having the particles of the food, thereby increasing home sanitation.

Furthermore, the inventive air passage structure can smoothly cool the electronic equipments of the microwave oven, thereby increasing the microwave oven in safety and reliability. Additionally, there is an advantage in that the internal air of the cavity can be easily exhausted through the plurality of outlet ports.

The invention claimed is:

1. A microwave oven, comprising:

a housing including a front plate, a back plate and a base plate;

a cooking cavity mounted within the housing, wherein the cooking cavity is spaced above the base plate, and wherein sidewalls of the cooking cavity include a plurality of ventilation holes;

a door mounted on a front of the housing;

an electronic equipment chamber mounted within the housing;

a plurality of first intake ports located at a front of the microwave oven;

a plurality of outlet ports formed on a lower portion of the front plate;

a barrier positioned below the cooking cavity, wherein the barrier separates a space below the cooking cavity into an outlet duct and an outlet space; and a circulation fan that draws air from outside the microwave oven into the first intake ports, wherein the fan generates a first flow of air that passes from the equipment chamber, into the outlet duct, and then out of at least one of the outlet ports, wherein the circulation fan also generates a second flow of air that passes from the equipment chamber through the cooking cavity via the ventilation holes in the sidewalls of the cooking cavity, into the outlet space, and then out of at least one of the outlet ports, and wherein the barrier prevents the second flow of air from entering the outlet duct.

2. The microwave oven of claim 1, wherein the plurality of first intake ports are formed in the door.

3. The microwave oven of claim 2, wherein the plurality of first intake ports are formed on an upper surface of the door.

4. The microwave oven of claim 1, wherein a communication port is formed in the barrier, the communication port allowing a portion of the first flow of air to pass from the outlet duct into the outlet space so that it mixes with the second flow of air before passing through the at least one outlet port.

5. The microwave oven of claim 4, wherein the communication port comprises a plurality of apertures formed in the barrier.

6. The microwave oven of claim 4, wherein the barrier further comprises an air guide part, and wherein the air guide part causes the portion of the first flow of air passing through the communication port to be guided towards the front of the microwave oven.

7. The microwave oven of claim 6, wherein the air guide part is formed by cutting and bending a portion of the barrier.

8. The microwave oven of claim 1, further comprising a second intake port formed on the back plate, wherein the circulation fan also draws air from outside the microwave oven into the second intake port to thereby form portions of the first and second flows of air.

9. The microwave oven of claim 8, wherein the plurality of first intake ports are formed on an upper surface of the door.

10. The microwave oven of claim 8, wherein a communication port is formed in the barrier, the communication port allowing a portion of the first flow of air to pass from the outlet duct into the outlet space so that it mixes with the second flow of air before passing through the at least one outlet port.

11. The microwave oven of claim 10, wherein the barrier further comprises an air guide part, and wherein the air guide part causes the portion of the first flow of air passing through the communication port to be guided towards the front of the microwave oven.

12. The microwave oven of claim 11, wherein the air guide part is formed by cutting and bending a portion of the barrier.

13. The microwave oven of claim 1, further comprising a second outlet port formed in the base plate, wherein a portion of the first flow of air exits the microwave oven through the second outlet port.

14. The microwave oven of claim 13, further comprising a second intake port formed on the back plate, wherein the circulation fan also draws air from outside the microwave oven into the second intake port to thereby form portions of the first and second flows of air.

15. A microwave oven, comprising:

a housing including a front plate, a back plate and a base plate;

a cooking cavity mounted within the housing, wherein the cooking cavity is spaced above the base plate, and wherein sidewalls of the cooking cavity include a plurality of ventilation holes;

a door mounted on a front of the housing;

an electronic equipment chamber mounted within the housing;

a first intake port located on an upper portion of the door;

a second intake port formed in the back plate;

a plurality of outlet ports formed on a lower portion of the front plate; and a circulation fan that draws air from outside the microwave oven into the first and second intake ports and uses the air to generate first and second flows of air, wherein the first flow of air passes from the equipment chamber, and then out of at least one of the outlet ports, and wherein the second flow of air passes from the equipment chamber, through the cooking cavity via the ventilation holes in the sidewalls of the cooking cavity, and then out of at least one of the outlet ports.

16. The microwave oven of claim 15, wherein the first intake port comprises a plurality of apertures formed on an upper portion of the door.

17. The microwave oven of claim 15, further comprising a barrier positioned below the cooking cavity, wherein the barrier separates a space below the cooking cavity into an outlet duct and an outlet space, wherein the first flow of air passes through the outlet duct and the second flow of air passes through the outlet space, and wherein the barrier prevents the second flow of air from passing into the outlet duct.

18. The microwave oven of claim 17, further comprising a communication port formed in the barrier, wherein the communication port allows a portion of the first flow of air to pass from the outlet duct into the outlet space.

19. The microwave oven of claim 18, wherein the barrier further comprises a guide that causes the portion of the first flow of air passing from the outlet duct into the outlet space to be guided towards the front of the microwave oven.

20. The microwave oven of claim 15, further comprising a second outlet port formed on the base plate, wherein a portion of the first flow of air exits the microwave through the second outlet port.

21. A microwave oven, comprising:

a housing including a front plate, a back plate and a base plate;

a cooking cavity mounted within the housing, wherein the cooking cavity is spaced above the base plate, and wherein sidewalls of the cooking cavity include a plurality of ventilation holes;

a door mounted on a front of the housing;

an electronic equipment chamber mounted within the housing;

a first intake port located on an upper portion of the door;

a plurality of first outlet ports formed on a lower portion of the front plate;

at least one second outlet port formed in the base plate; and a circulation fan that draws air from outside the microwave oven into the first intake port and uses the air to generate first and second flows of air, wherein a first portion of the first flow of air passes from the equipment chamber, and then out of at least one of the plurality of first outlet ports, wherein a second portion of the first flow passes from the equipment chamber and then out of the at least one second outlet port, and wherein the second flow of air passes from the equipment chamber, through the cooking chamber via the ventilation holes in the sidewalls of the cooking chamber, and then out of at least one of the first outlet ports.

22. The microwave oven of claim 21, wherein the first intake port comprises a plurality of apertures formed on an upper portion of the door.

23. The microwave oven of claim 21, further comprising a barrier positioned below the cooking cavity, wherein the barrier separates a space below the cooking cavity into an outlet duct and an outlet space, wherein the first flow of air passes through the outlet duct and the second flow of air passes through the outlet space, and wherein the barrier prevents the second flow of air from passing into the outlet duct.

24. The microwave oven of claim 23, further comprising a communication port formed in the barrier, wherein the communication port allows a portion of the first flow of air to pass from the outlet duct into the outlet space.

25. The microwave oven of claim 24, wherein the barrier further comprises a guide that causes the portion of the first flow of air passing from the outlet duct into the outlet space to be guided towards the front of the microwave oven.

26. A microwave oven, comprising:

a housing including a front plate, a back plate and a base plate;

a cooking cavity mounted within the housing, wherein the cooking cavity is spaced above the base plate, and wherein sidewalls of the cooking cavity include a plurality of ventilation holes;

an electronic equipment chamber mounted within the housing;

a door mounted on a front of the housing;

a plurality of intake ports located on an upper portion of the door;

a plurality of outlet ports formed on a lower portion of the front plate; and a circulation fan that draws air from outside the microwave oven into the plurality of intake ports and uses the air to generate first and second flows of air, wherein the first flow of air passes from the equipment chamber, and then out of at least one of the outlet ports, and wherein the second flow of air passes from the equipment chamber, through the cooking cavity via the ventilation holes in the sidewalls of the cooking cavity, and then out of at least one of the outlet ports.

27. The microwave oven of claim 26, wherein the plurality of intake ports are formed on a top edge of the door.

28. The microwave oven of claim 26, further comprising a barrier positioned below the cooking cavity, wherein the barrier separates a space below the cooking cavity into an outlet duct and an outlet space, wherein the first flow of air passes through the outlet duct and the second flow of air passes through the outlet space, and wherein the barrier prevents the second flow of air from passing into the outlet duct.

29. The microwave oven of claim 28, further comprising a communication port formed in the barrier, wherein the communication port allows a portion of the first flow of air to pass from the outlet duct into the outlet space.

30. The microwave oven of claim 29, wherein the barrier further comprises a guide that causes the portion of the first flow of air passing from the outlet duct into the outlet space to be guided towards the front of the microwave oven.

* * * * *